United States Patent [19]

Pieszchala

[11] 3,958,752

[45] May 25, 1976

[54] SIGNAL DEVICE FOR USE IN CONJUNCTION WITH A MAILBOX, NEWSPAPER TUBE, LOCK BOX OR SIMILAR DEVICE

[76] Inventor: Chester A. Pieszchala, 2005 Mustang Drive, La Porte, Ind. 46350

[22] Filed: Jan. 27, 1975

[21] Appl. No.: 544,135

[52] U.S. Cl. ..... 232/35; 116/132 R

[51] Int. Cl.[2] ..... B65D 91/00; G08B 5/00

[58] Field of Search ..... 232/35, 34, 36, 37; 49/13, 14; 109/38, 43; 116/81, 85, 86, 94, 100, 132 R, 132 A, 134, 165

[56] References Cited

UNITED STATES PATENTS

| | | | |
|---|---|---|---|
| 884,964 | 4/1908 | Voss | 232/35 |
| 1,102,977 | 7/1914 | Carver | 232/35 |
| 1,685,874 | 10/1928 | Feist | 232/35 |
| 2,480,469 | 8/1949 | Horn | 232/35 |
| 2,600,609 | 6/1952 | Barton | 116/94 |
| 2,807,410 | 9/1957 | Ward | 232/35 |
| 3,034,706 | 5/1962 | Wing | 232/35 |
| 3,143,287 | 8/1964 | Holt | 232/35 |
| 3,291,386 | 12/1966 | Van Fleet | 232/35 |
| 3,318,516 | 5/1967 | Scheerer | 232/35 |
| 3,482,543 | 12/1969 | Guidos | 232/35 X |
| 3,589,329 | 6/1971 | Schuh | 116/132 R |

*Primary Examiner*—Roy D. Frazier
*Assistant Examiner*—William E. Lyddane
*Attorney, Agent, or Firm*—Oltsch & Knoblock

[57] ABSTRACT

A flag type signal device which can be mounted to a mailbox, newspaper tube, lock box or similar device and which includes an actuator cord which when the mailbox is opened, newspaper tube utilized or lock box opened, releases a flag indicator to permit the indicator to shift into a signalling position.

6 Claims, 8 Drawing Figures

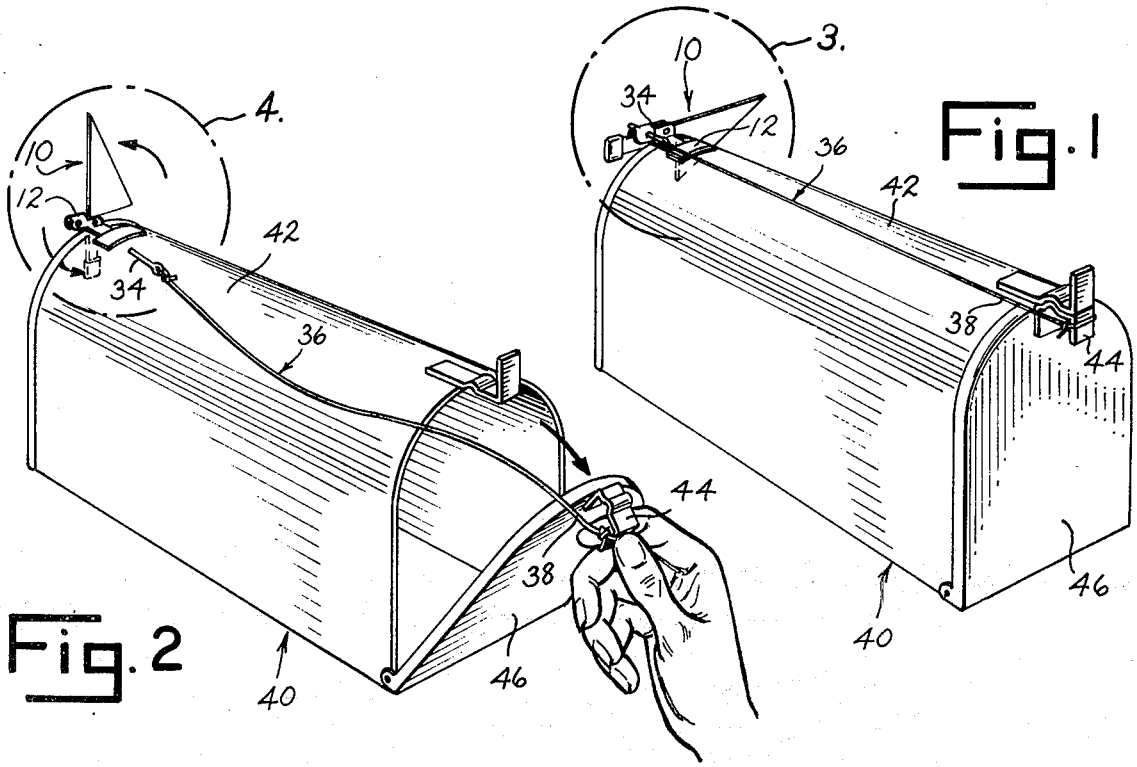
Fig. 1
Fig. 2
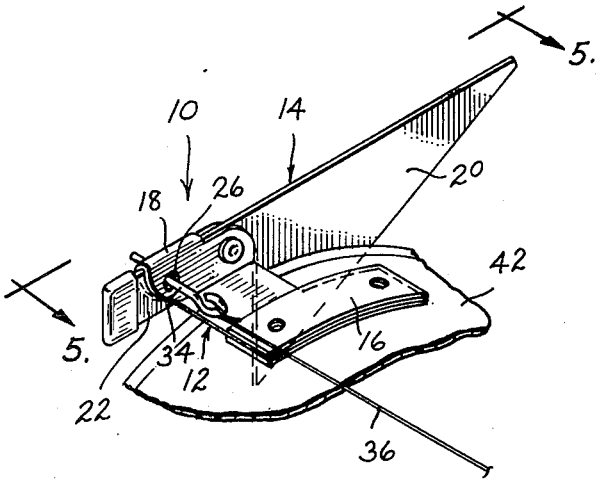
Fig. 3
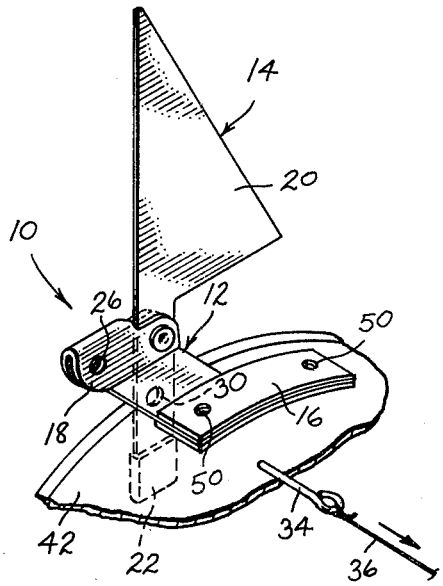
Fig. 4

Fig. 5
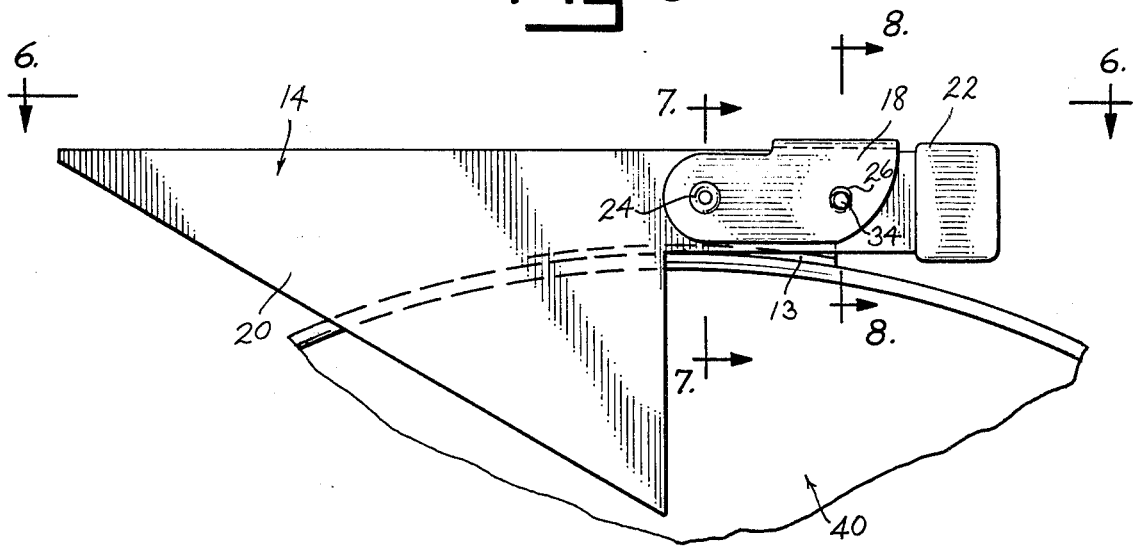
Fig. 6
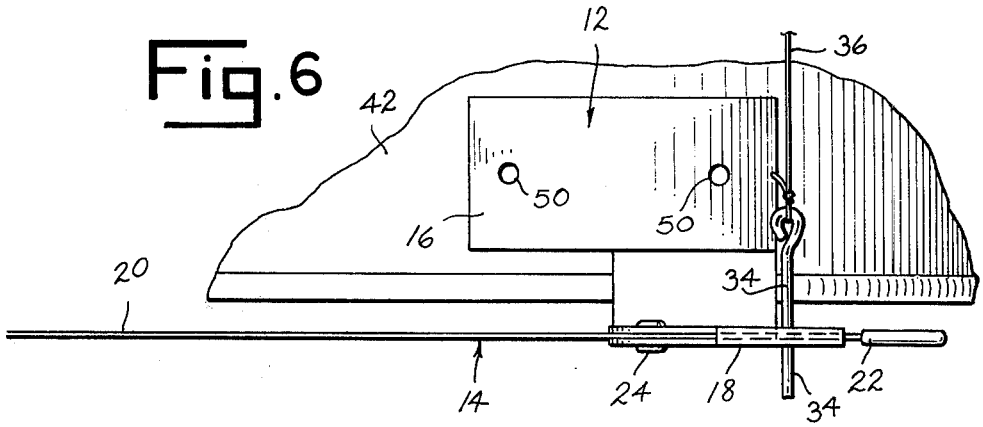
Fig. 7
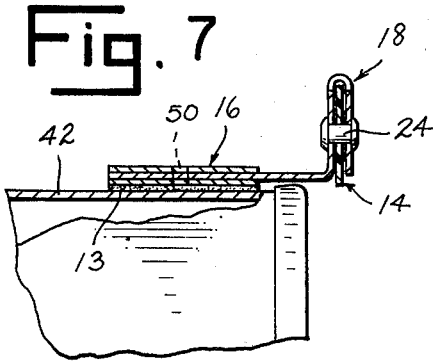
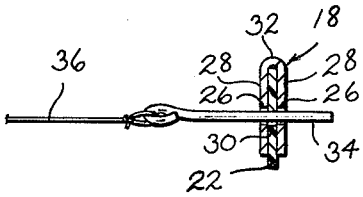
Fig. 8

SIGNAL DEVICE FOR USE IN CONJUNCTION WITH A MAILBOX, NEWSPAPER TUBE, LOCK BOX OR SIMILAR DEVICE

SUMMARY OF THE INVENTION

This invention relates to a signal device which produces a visual means by which one can ascertain whether a mailbox, newspaper tube, lock box or similar object has been utilized or opened.

The signal device of this invention includes a bracket means for mounting to the mailbox, newspaper tube, lock box or similar object. A flag part is pivotally connected to the bracket means and is shiftable between first and second signal indicating positions. A pin connected to an actuator cord secures the flag part in its first signal indicating position. The opposite end of the actuator cord is associated with the mailbox or similar object in such a manner that when the door of the mailbox is opened or the object utilized, the actuator cord is pulled, causing withdrawal of the pin and the release of the flag part which shifts into its second signal indicating position.

The bracket means of the signal device can be simply mounted to the mailbox or newspaper tube without the utilization of hand tools. The signal device of this invention may also be utilized as a security means when mounted to a lock box or to a window sill to indicate the presence of an unlawful entry into the box or the presence of a prowler near the window.

Accordingly, it is an object of this invention to provide a visual signal device which may be mounted to a mailbox or newspaper tube for the purpose of indicating delivery of mail or a newspaper.

Another object of this invention is to provide a signal device which is of economical manufacture and which can be simply applied to a mailbox or similar object for the purpose of indicating the receipt of mail.

Still another object of this invention is to provide a visual signal device which can be adapted for security purposes, such as indicating the presence of a prowler about the outside of a house or the unlawful entry into a lock box or other secured object or area.

Other objects of this invention will become apparent upon a reading of the invention's description.

BRIEF DESCRIPTION OF THE DRAWINGS

A preferred embodiment of this invention has been chosen for purposes of illustration and description wherein:

FIG. 1 is a perspective view of a mailbox showing the signal device of this invention mounted thereto.

FIG. 2 is a perspective view of the mailbox of FIG. 1 showing the door thereof being opened with the signal device of this invention producing a visual means indicating the opening of the box.

FIG. 3 is an enlarged detail view of that portion of the signal device enclosed by broken line 3 of FIG. 1 showing the device in a first signal indicating operative position.

FIG. 4 is a detailed perspective view of that portion of the signal device enclosed by broken line 4 of FIG. 2 showing the device in a second signal indicating operative position.

FIG. 5 is a side view of the signal device seen from line 5—5 of FIG. 3.

FIG. 6 is a top view of the signal device as seen from line 6—6 of FIG. 5.

FIG. 7 is a sectional view of the signal device taken along line 7—7 of FIG. 5.

FIG. 8 is a fragmentary sectional view of the signal device taken along line 8—8 of FIG. 5.

DESCRIPTION OF THE PREFERRED EMBODIMENT

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

Signal device 10 includes a mounting bracket 12 to which a flag part 14 is connected. Bracket 12 includes a mounting plate 16 and an inverted channel shaped arm 18. One end 20 of flag part 14 forms a signal indicator which may be brightly colored. The opposite end 22 of the flag part is weighted in a suitable manner. Flag part 14 is pivotally connected between its ends 20 and 22 to arm 18 of bracket 12 by a rivet 24, with indicator end 20 being shiftable from the horizontal position shown in FIG. 1 and the vertical position shown in FIG. 2 under the weighted influence of end 22 of the flag part.

With indicator end 20 of the flag part located in its horizontal position, end 22 thereof fits into the inverted channel of arm 18 as best shown in FIGS. 3 and 8. A pair of aligned openings 26 are formed in the side flanges 28 of bracket arm 18. An opening 30 is formed in flag part 14 adjacent its end 22. When end 22 of the flag part is brought upwardly into contact with the web 32 connecting side flanges 28 of the bracket arm to position indicator end 20 of the flag part in its horizontal position, opening 30 in the flag part will align itself with openings 26 in the bracket arm. A pin 34 fits removably within aligned openings 30 and 26 of the flag part and bracket, as best shown in FIGS. 3, 6 and 8, for the purpose of securing indicator end 20 of the flag part in its horizontal position. An actuator cord 36 is connected at one end to an eyelet formed in pin 34. The opposite end 38 of cord 36 when pulled causes pin 34 to be retracted from mounting bracket 12, thereby freeing flag part 14 for pivotal movement with indicator end 20 of the flag part shifting from its horizontal position shown in FIG. 1 into its vertical position shown in FIG. 2 through the influence of weighted end 22 of the flag part.

The manner in which signal device 10 is attached to a mailbox or similar object may vary. In the figures, mounting bracket 12 is shown connected to mailbox 40 adjacent its rear end wall with flag part 14 being free to pivot relative to the bracket. Mounting plate 16 of bracket 12 may include a pressure sensitive adhesive 13 or similar bonding material which causes the bracket when pressed into contact with the mailbox at its top wall 42 to be firmly secured in place. End 38 of cord 36 is tied to pull latch 44 mounted to the door 46 of mailbox 40 with the cord extending in a slightly taut condition the length of the mailbox along its top wall 42. When door 46 of mailbox 40 is opened as illustrated in FIG. 2, cord 36 will be pulled toward the front of the mailbox, causing pin 34 to be withdrawn from mounting bracket 12 to permit indicator end 20 of the flag part to pivot upwardly into its vertical position indicating that the mailbox has been opened.

When signal device 10 is utilized in conjunction with a newspaper tube, cord 36 would be located partially within or across the open end of the tube so that as a newspaper or similar article is inserted into the tube the cord will be contacted and tightened, causing pin 34 to be withdrawn from the tube attached mounting bracket 12. As a security device, mounting bracket 10 could be attached to a window sill or similar accessible location with cord 36 anchored by suitable tie-downs slightly above ground level below the window. When an individual approaches the window his feet will contact cord 36 to cause the cord to pull pin 34 from bracket 12 with indicator end 20 of flag part 14 shifting into its vertical signal indicating position to inform the occupants of the building or house that someone was outside the window. A buzzer or similar audible alarm device can also be incorporated with signal device 10 so that upon actuation of cord 36 and the pivotal movement of flag part 14, an audible sound will be produced.

Plate 16 of mounting bracket 12 may be either formed with an arcuate configuration so as to conform to the curvature of a mailbox or mailing tube wall or formed from a flexible material which permits the plate to be bent during application to conform to the outer surface of the mailbox or newspaper tube. Should the surface to which mounting bracket 12 is to be attached be unsuitable for the use of adhesive 13, such as when the surface is rusted, plate 16 of the bracket is provided with a plurality of holes 50 through which suitable screws can be inserted and turned into the underlying supporting surface.

It is to be understood that the invention is not to be limited to the details above given but may be modified within the scope of the appended claims.

What I claim is:

1. A signal device for a mailbox, newspaper tube, lock box or similar object comprising a bracket means, a flag part having an indicator end and an opposite end, means pivotally connecting said flag part between its ends to said bracket means, said flag part opposite end including means for causing said flag part indicator end to shift from a first indicating position into a second indicating position upon free pivotal movement of said flag part relative to said bracket means, means mounting said bracket means to said object with said flag part being positioned exteriorly of said object, said bracket means having an opening therein, said flag part having an opening therein aligned with said bracket means opening when said flag part indicator end is located in its first indicating position, pin means releasably extending into said aligned openings for securing said flag part indicator end into its first indicating position, an actuator cord having one end means connected to said pin and having its opposite end means connected to said object at a selected location, said cord effecting withdrawal of said pin from said aligned openings in response to movement of said selected location relative to said bracket or in response to movement of said cord relative to said selected location to permit said flag part indicator end to shift from its first indicating position to its said second indicating position.

2. The signal device of claim 1 wherein said object includes a door, said cord opposite end means being connected to said door for relative movement to said bracket when said door is opened to withdraw said pin from said aligned openings.

3. The signal device of claim 2 wherein said mounting means for said bracket means includes an adhesive carried by said bracket means.

4. The signal device of claim 3 wherein said adhesive is of the pressure sensitive type.

5. The signal device of claim 2 wherein said bracket means includes a mounting plate and an arm, said plate being secured to said object at a location spaced from the door of said object, said arm having an inverted U-shaped configuration defined by two spaced flanges interconnected by a web, aligned openings formed in said flanges, said connecting means for said flag part and bracket means connecting sad flag part to said arm with said flag part opposite end fitting between said flanges and under said web, said flag part opening being aligned with said aligned openings in said arm flanges and receiving said pin when said flag part opposite end contacts said web with said flag part indicator end located in its first indicating position.

6. The signal device of claim 2 wherein said door includes latch means by which the door is opened, said cord opposite end means being tied to said latch means.

* * * * *